US008941454B2

(12) United States Patent
Grunschlag et al.

(10) Patent No.: US 8,941,454 B2
(45) Date of Patent: Jan. 27, 2015

(54) SOLENOID WITH A PLUG-IN AND TURN FASTENING

(71) Applicant: Thomas Magnete GmbH, Herdorf (DE)

(72) Inventors: Jochen Grunschlag, Daaden (DE); Michael Stockschlader, Herdorf (DE)

(73) Assignee: Thomas Magnete GmbH, Herdorf (DE)

( * ) Notice: Subject to any disclaimer, the term of this patent is extended or adjusted under 35 U.S.C. 154(b) by 0 days.

(21) Appl. No.: 13/771,480

(22) Filed: Feb. 20, 2013

(65) Prior Publication Data

US 2013/0234816 A1 Sep. 12, 2013

(30) Foreign Application Priority Data

Feb. 24, 2012 (DE) ..... 10 2012 003 648

(51) Int. Cl.
*H01F 7/00* (2006.01)

(52) U.S. Cl.
USPC ..... 335/278; 335/220

(58) Field of Classification Search
USPC ..... 335/220–234, 251–256, 281–285, 278; 251/129.01–129.22; 29/529.1; 403/349
See application file for complete search history.

(56) References Cited

U.S. PATENT DOCUMENTS

| | | | | |
|---|---|---|---|---|
| 7,009,478 | B2 | 3/2006 | Ermert et al. | |
| 2004/0135658 | A1 | 7/2004 | Ermert et al. | |
| 2006/0071560 | A1 | 4/2006 | Ermert et al. | |
| 2012/0000291 | A1 * | 1/2012 | Christoph et al. | 73/700 |
| 2012/0312262 | A1 | 12/2012 | Hoppe et al. | |
| 2013/0039697 | A1 * | 2/2013 | Plankl et al. | 403/349 |
| 2013/0055822 | A1 * | 3/2013 | Frank | 73/756 |

FOREIGN PATENT DOCUMENTS

| | | | |
|---|---|---|---|
| DE | 10238840 | A1 | 3/2004 |
| DE | 102007020092 | A1 | 11/2008 |
| DE | 102009020652 | A1 | 11/2010 |
| DE | 102010012917 | A1 | 4/2011 |
| DE | 102010008931 | A1 | 8/2011 |
| DE | 202010007406 | U1 | 9/2011 |
| WO | WO-2008131833 | A1 | 11/2008 |

OTHER PUBLICATIONS

Opposition paper by ETO regarding German Priority application No. 10 2012003648.5.

(Continued)

*Primary Examiner* — Bernard Rojas
(74) *Attorney, Agent, or Firm* — Harness, Dickey & Pierce, PLC

(57) ABSTRACT

A proportionally acting solenoid with a plastics encapsulation having a fastening flange which is integrally formed thereon and contains shaped elements which permit installation of the solenoid onto the housing by axial pressing in, rotation and rotary latching, the shaped elements, in interaction with metallic springs and shaped elements of the housing, holding the solenoid on a housing axially and against rotation, and the springs being tensioned upon rotation of the housing during the installation, and the seal which seals the radial gap between the solenoid and the housing being coordinated, by means of the configuration thereof, with a small axial installation force.

12 Claims, 3 Drawing Sheets

(56) References Cited

OTHER PUBLICATIONS

Answer by Thomas Magnete regarding German Priority application No. 10 2012003648.5.

Decision by the board, including the amendment (by Thomas Magnete) regarding German Priority application No. 10 2012003648.5.

* cited by examiner

SOLENOID WITH A PLUG-IN AND TURN FASTENING

CROSS-REFERENCE TO RELATED APPLICATIONS

This application claims benefit of German Application No. 10 2012 003 648.5, filed on Feb. 24, 2012. The entire disclosure of the above application is incorporated herein by reference.

FIELD

The present disclosure relates to a proportionally acting solenoid.

BACKGROUND

This section provides background information related to the present disclosure which is not necessarily prior art.

Proportionally acting solenoids are known from camshaft adjustment devices of internal combustion engines, said solenoids having been developed to meet the special requirements of this application, for example the magnets described in DE 10238840 and DE 102007020092. Magnets which are fastened with a plug-in and turn movement are also known, for example the embodiment described by DE 102009020652.

Devices for installation by means of plug-in and turn movements are also known in general; they are also referred to as quarter-turn fastenings.

SUMMARY

This section provides a general summary of the disclosure, and is not a comprehensive disclosure of its full scope or all of its features.

It is the problem of this disclosure to develop the technical teaching of DE 102009020652 and, in the process, in particular to permit easier installation with lower axial forces because, in the event of confined installation conditions, the application of higher axial forces is especially difficult and the view of the installation site is restricted.

The proportionally acting solenoid according to the disclosure can have a plastics encapsulation, on which a fastening flange can be integrally formed, the fastening flange containing shaped elements which, for installation of the solenoid in the housing, permit axial pressing in, rotation and rotary latching. In this case, only a small axial force is applied for the installation.

The shaped elements facilitate the relative positioning of the solenoid with respect to the fitting bore and, in interaction with metallic springs and further shaped elements of the housing, can hold the solenoid on the housing axially and against rotation by resilient latching.

The spring tensioning required for the latching and for the pressing of the solenoid onto the housing is not produced during the axial pressing in but rather upon rotation of the solenoid during installation.

The disclosure is explained further by the following exemplary features of the shaped elements and of the springs:

The metallic springs can be fastened in a clamping manner either to the fastening flange of the proportional magnet or to the shaped elements of the housing.

When the springs are fastened to the fastening flange, the shaped elements of the housing, by means of integrally formed bevels, can bring about tensioning of the springs upon rotation and, in interaction with the shape of the springs, the ends of which have a rounding, can prevent the springs from moving under the shaped elements upon rotation of the flange.

When the springs are fastened to the housing, the shaped elements of the fastening flange, by means of integrally formed bevels, can bring about tensioning of the springs upon rotation and, in interaction with the shape of the springs, the ends of which have a rounding, can prevent the springs from moving under the shaped elements upon rotation of the flange.

The shaped elements of the fastening flange or the shaped elements of the housing can contain a stop for the springs, the stop limiting the rotational movement of the proportional magnet during installation.

The shaped elements of the fastening flange can contain blind holes which facilitate the application of a torque during the installation or during the removal of the proportional magnet.

The shaped elements of the fastening flange can contain centering aids which permit radial orientation of the proportional magnet during the installation into the receiving bore in the housing.

One of the shaped elements of the fastening flange or the shaped elements of the housing, relative to which the springs move during the rotational movement, can contain a short latching notch with close tolerances, said latching notch, in interaction with a shaped element of the spring, fixing and holding the rotational angle of the proportional magnet relative to the housing. The other shaped element or the other shaped elements can contain considerably longer notches which are not of importance for the fixing of the rotational angle.

The radial gap between the solenoid and the housing can be sealed by a seal which is coordinated, by means of the configuration thereof, to the small axial force which can be applied during installation.

For this purpose, the seal bears with two sealing lips in each case against an outer cylindrical surface of the solenoid and against an inner cylindrical surface of the housing. During the installation, the sealing lips of the seal can be deformed, but the seal is not compressed and is only slightly deformed in the core thereof. This permits installation with little axial force. In a development, the seal can contain a toroidal cavity which additionally facilitates the deformation.

In a further development, the seal can contain an additionally encircling, axially acting and slightly deformable sealing lip which can prevent liquids from penetrating from the outside into the gap between the proportional magnet and the housing.

The solenoid according to the disclosure can easily be fitted even in very confined installation conditions because only a small axial force is required for pushing the magnet into the housing, and the rotation and latching of the solenoid are facilitated by the configuration of the fastening flange and the shaped elements thereof. The configuration of the seal also reduces the axial force required. Low costs are achieved for the fastening device because of the use of metallic spring elements made of sheet metal.

Proportionally acting solenoids of the type described can be used in camshaft adjustment devices of internal combustion engines. They are suitable in particular whenever the valve which is to be activated revolves with the camshaft and the stationary solenoid is fastened to the valve gear housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
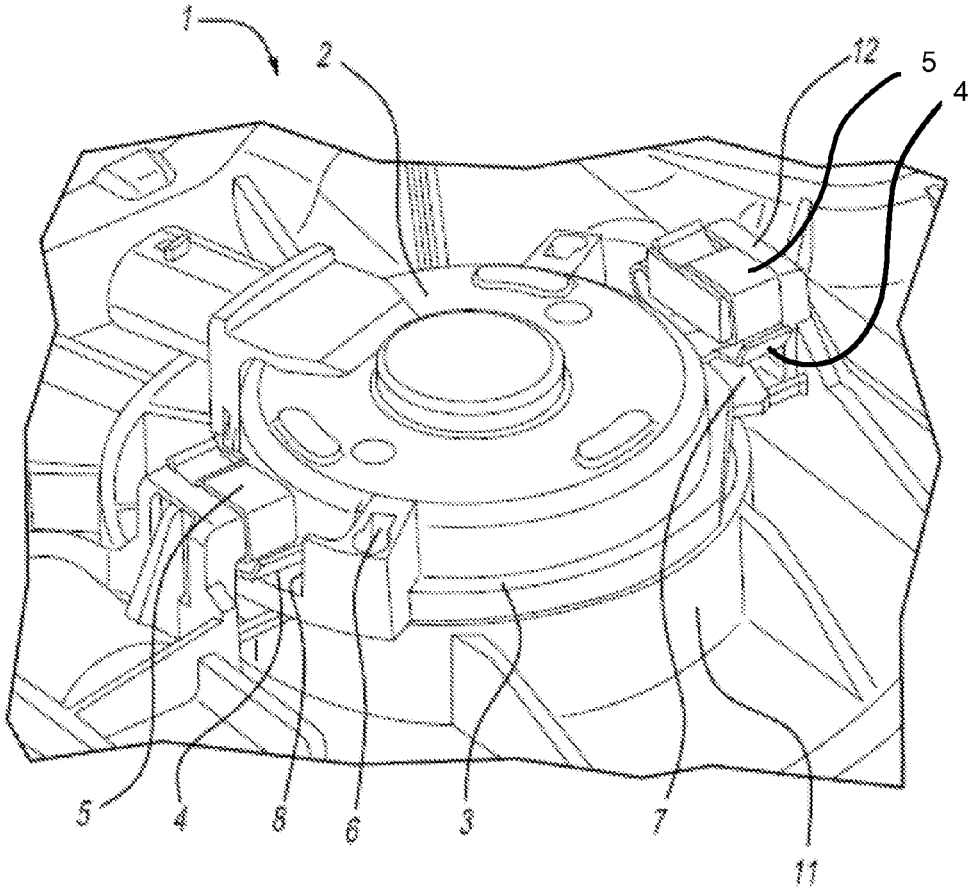
FIG. 1 shows, in an oblique view, the installed solenoid in the completely fitted state.
Figure 2:
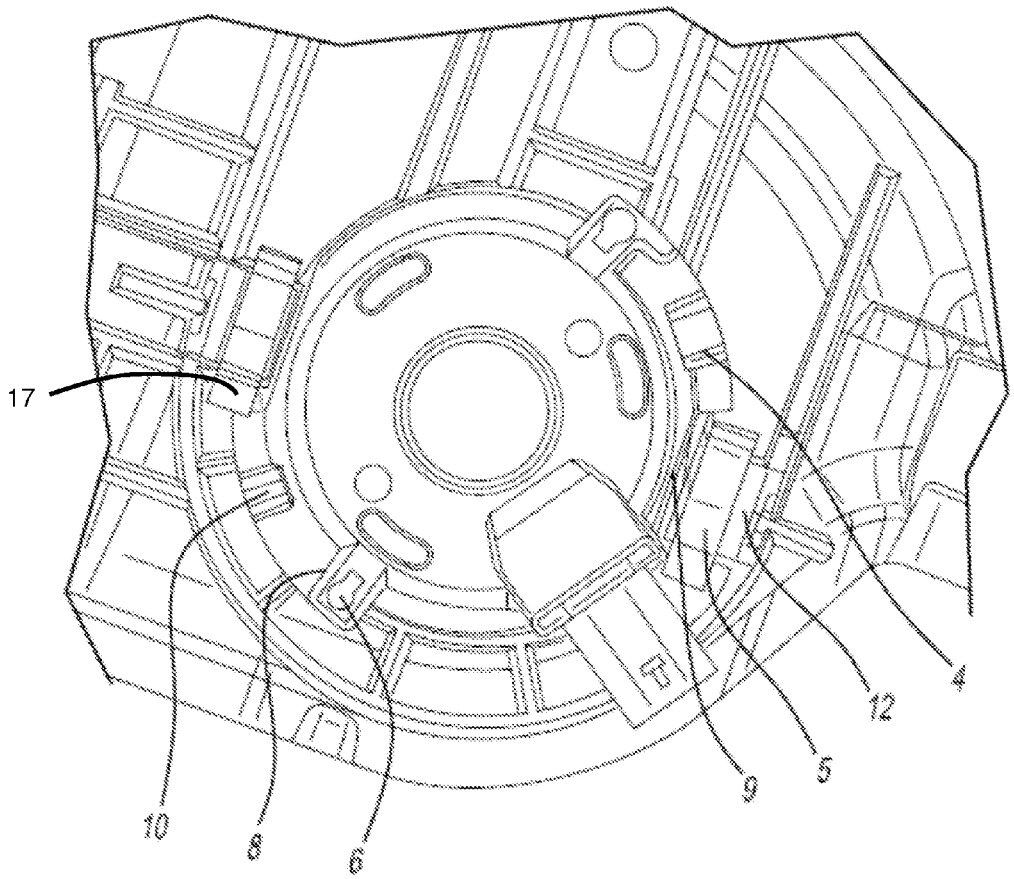
FIG. 2 shows, in a top view, the solenoid in an axially pushed-in, but not yet rotated state.
Figure 3:
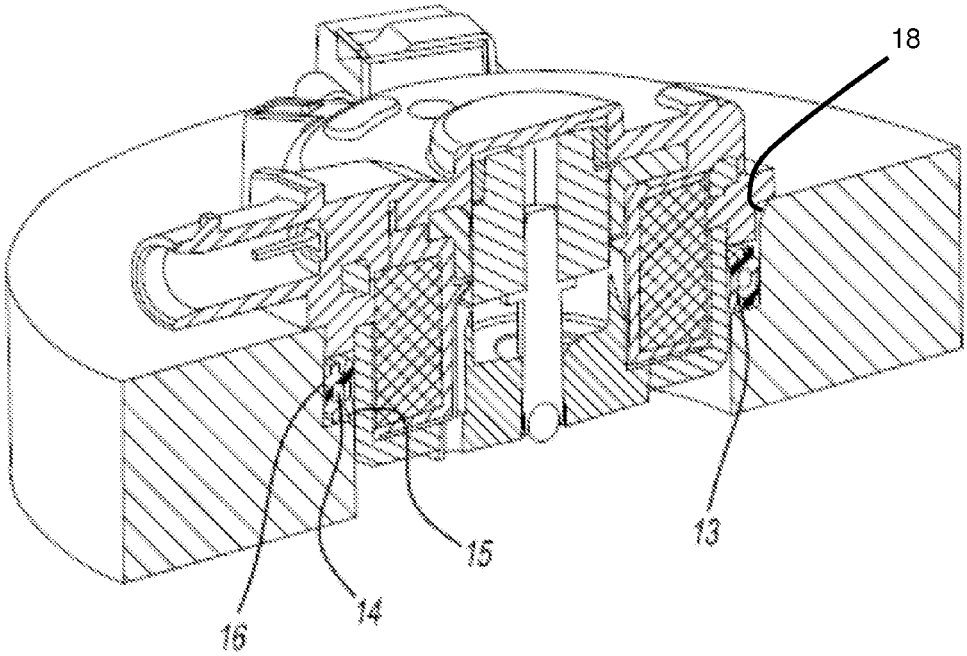
FIG. 3 shows the seal 13 and the surroundings thereof.

Example embodiments will now be described more fully with reference to the accompanying drawings.

The proportionally acting solenoid 1 has a plastics encapsulation 2 having a fastening flange 3 which is integrally formed thereon and contains shaped elements 4. The latter permit axial pressing in, rotation and rotary resilient latching in order to install the solenoid 1 on the housing 11. In interaction with metallic springs 5 and shaped elements 12 of the housing 11, the shaped elements 4 hold the solenoid on a housing 11 axially, radially and against rotation. In this case, only a small axial force is applied to the installation.

The metallic springs 5 are fastened in a clamping manner to the shaped elements of the housing 12 and, upon rotation of the solenoid 1 during the installation, are tensioned when the springs 5 run onto the integrally formed bevels 7 of the shaped elements 4. In the process, the shape of the integrally formed bevels 7 in interaction with the springs 5, by means of the configuration of the ends thereof, prevents the springs 5 from moving under the shaped elements 4 upon rotation of the flange 3.

The shaped elements 4 contain a stop 8 for the springs 5, the stop 8 limiting the rotational movement of the proportional magnet 1 during installation.

The shaped elements 4 contain blind holes 6 which facilitate the application of a torque during installation or during removal of the proportional magnet 1.

The shaped elements 4 contain centering aids 9 which facilitate a radial orientation of the proportional magnet 1 during installation in the receiving bore in the housing 11.

One of the shaped elements 4 contains a short latching notch 10 with close tolerances, said latching notch, in interaction with a shaped element 17 of the spring 5, fixing and holding the rotational angle of the proportional magnet relative to the housing 11, while the other shaped element contains a considerably longer notch which is not of importance for the fixing of the rotational angle.

The seal 13 seals the radial gap between the solenoid 1 and the housing 11 by bearing with two sealing lips 15 in each case against the cylindrical surfaces of the solenoid 1 and of the housing 11, the sealing lips 15 especially and, only to a small extent, the core of the seal 13 being deformed during installation.

As an alternative, the seal 13 contains an additional encircling and axially acting sealing lip 16 which prevents liquids from penetrating from the outside into the gap between the proportional magnet and the housing 11.

During the installation of a proportionally acting solenoid 1 into a housing 11, first of all, springs 5 formed from metal sheets are fastened in a clamping manner to shaped elements 12 of the housing 11. The solenoid is then oriented with respect to the housing 11 by means of the centering aids 9 and pushed axially into the receiving bore in the housing 11, whereupon the seal 13 is also brought into the operating position thereof, and then the solenoid, located in the bore, is rotated by application of an installation torque to the blind holes 6. In the process, the springs 5 run onto integrally formed bevels 7 of the opposite shaped elements 4 and are tensioned, and all of the springs press the solenoid against the housing, and one of the springs 5 at the end of the rotational movement, the end being determined by the stop 8, latching resiliently in a short latching notch 10 while the other springs each rest in a longer notch.

LIST OF REFERENCE NUMBERS

1. Solenoid
2. Plastics encapsulation
3. Fastening flange
4. Shaped element (flange side)
5. Spring
6. Blind hole
7. Bevel
8. Stop
9. Centering aid (flange side)
10. Latching notch
11. Housing
12. Shaped element (housing side)
13. Seal
14. Cavity
15. Sealing lip (radially)
16. Sealing lip (axially)
17. Shaped element (spring)
18. Centering aid (housing side)

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A proportionally acting solenoid comprising:

a plastics encapsulation having a fastening flange which is integrally formed thereon and contains first shaped elements which, in interaction with second shaped elements of a housing, permit installation of the solenoid onto the housing and partially into a receiving bore in the housing by pressing the solenoid into the receiving bore along a longitudinal axis of the receiving bore and rotating the solenoid, the first shaped elements and the second shaped elements holding the solenoid on and partially in the housing axially and against rotation by latching preventing the rotational movement, wherein springs which consist of metallic sheet metal take on both axial pretensioning for mounting of the solenoid and resilient latching for holding rotational position, and wherein pretensioning forces of the springs for the mounting of the solenoid and for the latching during the rotation of the solenoid are produced during the installation by integrally formed bevels on the first shaped elements, and wherein a seal seals a radial gap between the solenoid and the housing with a small axial installation force, and wherein the metallic springs are fastened in a clamping manner to at least one of the fastening flange of the proportional solenoid or to the second shaped elements of the housing.

2. The proportionally acting solenoid as claimed in claim 1, wherein the metallic springs are fastened in a clamping manner to the second shaped elements of the housing.

3. The proportionally acting solenoid as claimed in claim 1, wherein the first shaped elements having the integrally formed bevels, tension the springs upon rotation of the solenoid and, in interaction with the springs to prevent the springs from moving under the first shaped elements upon rotation of the flange.

4. The proportionally acting solenoid as claimed in claim 1, wherein the first shaped elements contain a stop for the springs, the stop limiting the rotational movement of the proportional solenoid during installation.

5. The proportionally acting solenoid as claimed in claim 1, wherein the first shaped elements contain blind holes which facilitate the application of a torque during the installation or during the removal of the proportional solenoid.

6. The proportionally acting solenoid as claimed in claim 1, wherein the first shaped elements contain centering aids which facilitate a radial orientation of the proportional solenoid during the installation into a receiving bore in the housing.

7. The proportionally acting solenoid as claimed in claim 1, wherein at least one of the first shaped elements, relative to which the springs move during the rotational movement, contains a short latching notch with close tolerances, said latching notch, in interaction with a shaped element of the springs, fixing and holding a rotational angle of the proportional solenoid relative to the housing while other first shaped element contain longer notches which are not of importance for the fixing of the rotational angle.

8. The proportionally acting solenoid as claimed in claim 1, wherein the seal bears with two sealing lips against cylindrical surfaces of the solenoid and of the housing, the seal being deformed, but not compressed, during the installation.

9. The proportionally acting solenoid as claimed in claim 8, wherein the seal contains a toroidal cavity which facilitates the deformation.

10. The proportionally acting solenoid as claimed in claim 9, wherein the seal contains an additional encircling, axially acting and easily deformable sealing lip which prevents liquids from penetrating from outside into a gap between the proportional solenoid and the housing.

11. A method for installing the proportionally acting solenoid as claimed in claim 1 in the housing, wherein the springs formed from metal sheets are fastened in a clamping manner to the second shaped elements of the housing, and wherein the solenoid is then oriented with respect to housing centering aids and is pushed axially with a low force into a receiving bore in the housing, whereupon the seal is also brought into the operating position thereof, and then the solenoid, located in the bore, is rotated by application of an installation torque to blind holes in the first shaped elements, the springs running onto the integrally formed bevels of the first shaped elements and being tensioned in the process, and all of the springs pressing the solenoid against the housing, and one of the springs latching resiliently in a short latching notch in the first shaped elements at the end of the rotational movement, an end being determined by a stop on the first shaped elements.

12. A proportionally acting solenoid system for securing a solenoid within a bore in a housing comprising:

a plastic encapsulation having a fastening flange integrally formed thereon and containing first shaped elements that are configured to interact with second shaped elements of the housing, each of the first shaped elements having an integrally formed bevel;

springs configured to be coupled to the second shaped elements of the housing, each spring formed from metallic sheet metal; and a seal configured to seal a radial gap between the solenoid and the housing with a small axial insertion force;

wherein upon interaction of the first shaped elements with the second shaped elements by axial pressing in and rotating of the solenoid, the integrally formed bevels of the first shaped elements engage the springs to provide axial pretensioning for mounting of the solenoid and resilient latching for holding rotational position of the solenoid, wherein pretensioning forces of the springs for the mounting of the solenoid and for the latching during the rotation of the solenoid are produced during the installation upon engagement of the integrally formed bevels.

* * * * *